US006682003B2

(12) United States Patent
Limmer

(10) Patent No.: US 6,682,003 B2
(45) Date of Patent: Jan. 27, 2004

(54) INJECTION NOZZLE

(75) Inventor: Andrew J. Limmer, Bury St Edmonds (GB)

(73) Assignee: Delphi Technologies, Inc., Troy, MI (US)

( * ) Notice: Subject to any disclaimer, the term of this patent is extended or adjusted under 35 U.S.C. 154(b) by 197 days.

(21) Appl. No.: 09/904,298

(22) Filed: Jul. 12, 2001

(65) Prior Publication Data

US 2002/0008165 A1 Jan. 24, 2002

(30) Foreign Application Priority Data

Jul. 18, 2000 (GB) ..... 0017542

(51) Int. Cl.[7] ..... B05B 1/30; B05B 1/34; F02M 47/02; F02M 51/00

(52) U.S. Cl. ..... 239/533.1; 239/533.2; 239/533.3; 239/88; 239/585.5

(58) Field of Search ..... 239/533.1, 533.2, 239/533.3, 533.9, 533.12, 585.1, 585.3, 585.4, 585.5, 88, 89, 91; 251/127, 129.15, 129.21

(56) References Cited

U.S. PATENT DOCUMENTS 1,952,816 A * 3/1934 Mock ..... 239/488
4,153,205 A * 5/1979 Parrish, Jr. ..... 239/533.9
4,528,951 A * 7/1985 Yamada ..... 123/300
5,033,679 A 7/1991 Golev et al. ..... 239/533.3
5,725,157 A * 3/1998 DeLuca ..... 239/533.9
5,890,660 A * 4/1999 Stevens ..... 239/533.3
6,070,811 A * 6/2000 Takeda et al. ..... 239/533.12
6,155,504 A * 12/2000 Sugimoto et al. ..... 239/596

FOREIGN PATENT DOCUMENTS

| | | |
|---|---|---|
| CH | 227224 | 8/1943 |
| DE | 3740283 | 6/1989 |
| DE | 4117910 | 12/1992 |
| EP | 0283154 | 2/1988 |
| WO | 9958844 | 11/1999 |

* cited by examiner

*Primary Examiner*—Davis Hwu
(74) *Attorney, Agent, or Firm*—David P. Wood

(57) ABSTRACT

An injection nozzle for use in delivering fuel to a combustion space comprises a nozzle body provided with a blind bore within which a valve member is slidable. The valve member comprises a first region of substantially frusto-conical form defining a seating surface which is engageable with a valve seating surface, defined by the blind bore, to control fuel delivery from the injection nozzle, and a second region arranged such that, when the valve member is seated against the valve seating surface, in use, the second region is located downstream of the valve seating surface. The first region subtends a first cone angle which is greater than a second cone angle subtended by the second region.

10 Claims, 2 Drawing Sheets

INJECTION NOZZLE

FIELD OF THE INVENTION

The invention relates to an injection nozzle for use in controlling fluid flow through an outlet. In particular, but not exclusively, the invention relates to an injection nozzle for use in a fuel injector for delivering fuel to an internal combustion engine.

BACKGROUND OF THE INVENTION

FIG. 1 shows an enlarged view of a conventional injection nozzle of a fuel injector comprising a valve needle 10 which is movable within a blind bore 12 provided in a nozzle body 14. A region of the valve needle 10, having a diameter 10*a*, is engageable with an annular valve seating 16 defined by a portion of the bore 12 to control fuel delivery through a set of outlet openings 18 provided in the nozzle body 14. In use, when the valve needle 10 is moved in an upward direction in the illustration shown away from the valve seating 16, fuel within a delivery chamber 19, defined by the bore 12 and the outer surface of the valve needle 10, is able to flow past the valve seating 16 and out through the outlet openings 18 into an associated engine cylinder or other combustion space.

The valve needle is provided with a compression spring (not shown) which serves to urge the valve needle against the valve seating 16 to prevent fuel injection through the outlet openings 18. Movement of the valve needle 10 away from the valve needle seating 16 to commence fuel injection may be controlled in several ways. For example, the pressure of fuel supplied to the delivery chamber 19 may be increased until such time as the force applied to the thrust surfaces (not shown) of the valve needle 10 is sufficient to overcome the spring force, thereby causing the valve needle 10 to be urged away from the valve seating 16 to permit fuel delivery through the outlet openings 18.

It is an important feature of fuel injector design that the fuel pressure at which the valve needle 10 moves away from the valve seating 16 to cause fuel injection to be commenced can be achieved with high accuracy. In order to achieve this, the effective diameter of the annular valve seating 16 against which the valve needle 10 seats must be machined and finished with high accuracy. During manufacture, it is therefore important to minimize variations in the effective diameter and in the surface finish of the valve seating 16. However, in practice, a high level of repeatability in the effective diameter and surface finish of the valve seating is difficult to achieve.

SUMMARY OF THE INVENTION AND ADVANTAGES

It is an object of the present invention to alleviate this problem.

According to a first aspect of the present invention, there is provided an injection nozzle for delivering fuel to a combustion space, the injection nozzle comprising a valve member including a first region of substantially frusto-conical form defining a seating surface which is engageable with a valve seating surface to control fuel delivery from the injector, and a second region arranged such that, when the valve member is seated against the valve seating surface, in use, the second region is located downstream of the valve seating surface, wherein the first region subtends a first cone angle which is greater than a second cone angle subtended by the second region.

The injection nozzle may preferably comprise a nozzle body provided with a blind bore within which the valve member is slidable, the blind bore defining the valve seating surface for the valve member. The nozzle body is preferably provided with at least one outlet opening through which fuel is delivered when the valve member is lifted from the valve seating surface.

The valve member is slidable within the blind bore, in use, to move the valve member in and out of engagement with the valve seating surface.

The invention permits the effective diameter of the valve seating to be achieved with greater accuracy and with greater repeatability during manufacture. As the second region of the valve member subtends a smaller cone angle than the first region, neither the portion of the first region downstream of the seating surface nor the second region can seat against the bore. Thus, the effective diameter of the surface of the valve member which seats against the valve seating, and hence the effective diameter of the valve seating, can be more accurately defined. High accuracy machining and finishing of valve seating is therefore less critical.

The invention also provides the advantage that high accuracy machining of the outer surface of the valve member is easier to achieve than high accuracy machining of the inner surface of a blind bore.

Preferably, the angular difference between the first cone angle subtended by the first region and the second cone angle subtended by the second region is substantially 1o.

Preferably, the first cone angle subtended by the first region may be substantially 61° and the second cone angle subtended by the second region may be substantially 60°.

Preferably, the length of the first region along the axis of the valve member may be less than or equal to 0.2 mm. The diameter of the first region, at the point at which the seating surface engages the valve seating surface, may be, for example, substantially 2.25 mm.

Conveniently, the second region of the valve member may be an end region of the valve member. The end region of the valve member may be of substantially frusto-conical or conical form.

The injection nozzle is suitable for use, for example, in unit/pump injectors and in fuel injectors arranged to be supplied with fuel from a common rail.

According to a second aspect of the present invention, there is provided a valve member for use in a filet injector or injection nozzle as herein described for delivering filet to a combustion space, the valve member comprising a first region of substantially frusto-conical form defining a seating surface which is engageable with a valve seating surface to control fuel delivery from the injector, and a second region arranged such that, when the valve member is seated against the valve seating surface, in use, the second region is located downstream of the valve seating surface, wherein the first region subtends a first cone angle which is greater than a second cone angle subtended by the second region.

The differential angle between the valve seating surface and the seating surface defined by the first region is preferably at least 1.5°.

According to a further aspect of the present invention, there is provided a method of manufacturing an injection nozzle for use in delivering fuel to a combustion space, the injection nozzle comprising a nozzle body and a valve member, the method comprising;

providing the nozzle body with a blind bore which is shaped to define a valve seating surface, machining the valve member to include a first region of substantially frusto-conical form which is shaped to subtend a first cone angle, the first region defining a seating surface which is engageable with the valve seating surface to control fuel delivery from the injection nozzle, and machining the valve member to include a second region which, when the valve member is seated against the valve seating surface, in use, adopts a position in which it is located downstream of the valve seating surface, and is shaped to subtend a second cone angle, wherein the first and second regions of the valve member are machined such that the first cone angle is greater than the second cone angle.

The method of manufacture permits the effective diameter of the valve seating to be achieved with greater accuracy and with greater repeatability during manufacture. Using this method, high accuracy machining and finishing of valve seating is less critical, as described previously.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 2:
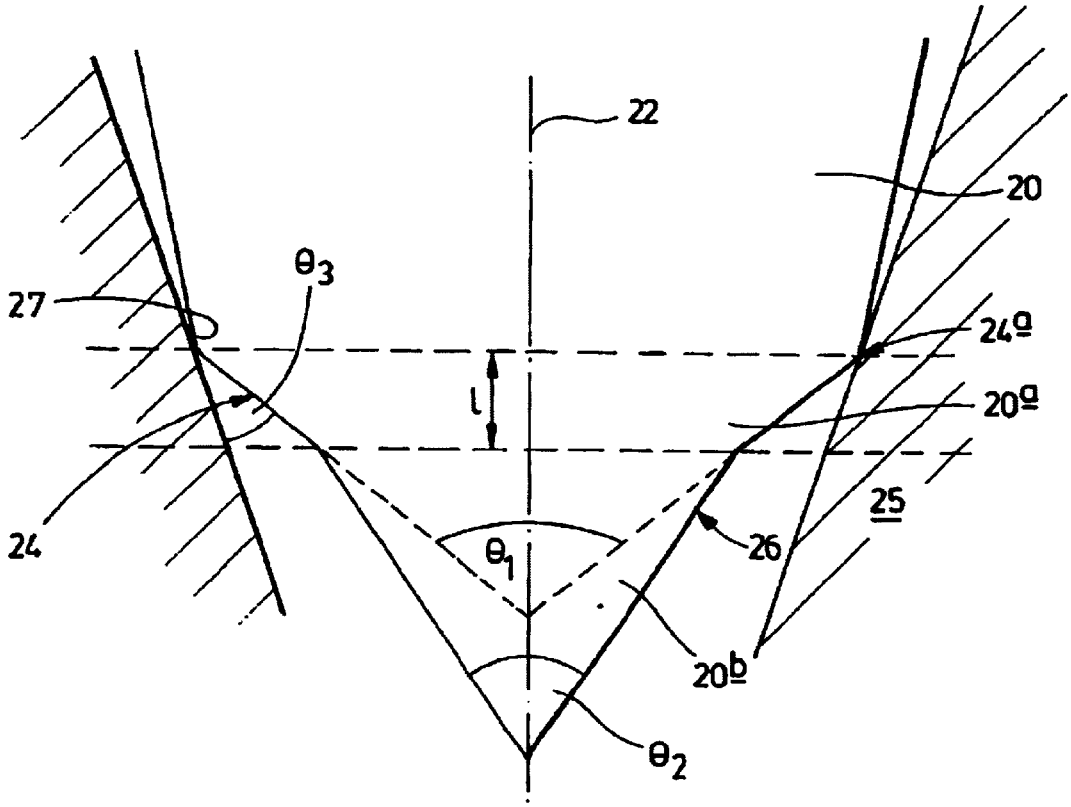
FIG. 2 is an enlarged, exaggerated view of a valve member in accordance with an embodiment of the present invention.

Referring to FIG. 2, there is shown a valve member 20 for use in an injection nozzle for delivering fuel to an engine cylinder, or other combustion space, of an internal combustion engine. The valve member 20 includes a first annular region 20*a* of substantially frusto-conical form and an end, tip region 20*b*, of substantially conical form, the end region 20*b* occupying a lower axial position along the axis 22 of the valve member 20. The end region 20*b* has an outer surface 26 and the first region 20*a* has an outer surface 24, the outer surface 24 of the first region 20*a* defining a seating surface 24*a* which is engageable with a valve seating surface 27 to control fuel delivery through outlet openings (not shown) provided in a nozzle body 25 of the injector. In an inwardly opening fuel injector, the valve seating is defined by a surface of a blind bore provided in the nozzle body, the valve member 20 being slidable within the blind bore, in use, to move the seating surface 24*a* into and out of engagement with the valve seating surface 27.

The first region 20*a* of the valve member 20 subtends a cone angle, $\theta_1$ of approximately 61° and the end region 20*b* subtends a cone angle, $\theta_2$ of approximately 60°. The angular difference between the cone angle $\theta_1$ and the cone angle $\theta_2$ is therefore approximately 1°. Typically, the length, l, of the region 20*a* along the axis of the valve member 20 is less than or equal to 0.2 mm, but may be as great as 0.4 mm. The diameter of the annular seating surface 24*g* which engages the valve seating is typically 2.25 mm. The difference in angle, $\theta_3$ between the seating surface 27 and the surface 24 of the region 20*a* is typically 1.5°. It will be appreciated, however, that the angle $\theta_2$ may be greater or less than this, depending on the angle subtended by the seating surface 27.

Figure 1:
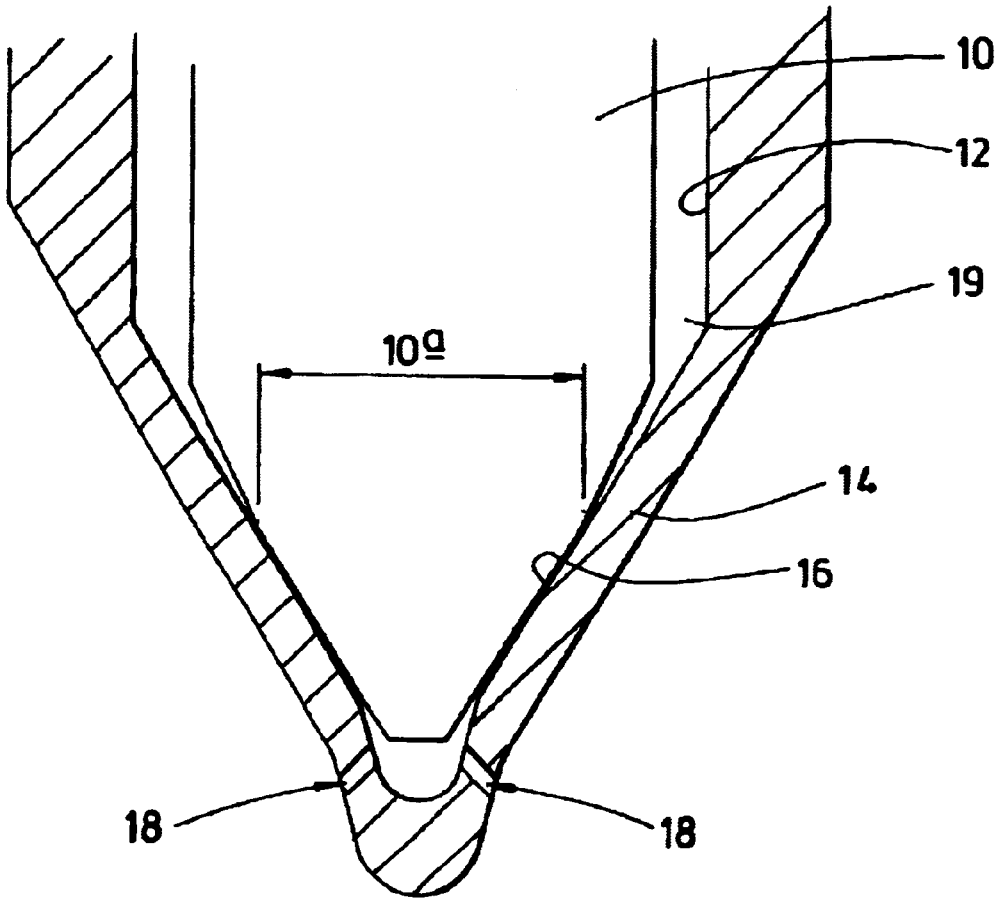
FIG 1 Prior Art
FIG. 1 is an enlarged view of a conventional fuel injector, including a valve member.

In conventional fuel injection nozzles, there is either no difference in cone angle between the end region of the valve member and the region defining the seating surface or, as shown in FIG. 1, the end region of the valve member subtends a greater cone angle than the region defining the seating surface. In the present invention, the angular difference between $\theta_1$ and $\theta_2$ being greater than $\theta_2$ ensures that the surface of the bore within which the valve member 20 is movable and against which the valve member 20 seats has an effective diameter which can be achieved with higher accuracy, and with greater repeatability, compared to known arrangements, the geometry of the valve member being such that only the seating surface 24*a* of the first region 20*a*, and not the remainder of the surface 24 or the surface 26 of the end region 20*b,* can seat against the end of the blind bore within which the valve member slides, in use.

The invention provides a particular advantage in injector arrangements for which the fuel pressure at which the valve member lifts away from the valve seating is critical. Furthermore, in conventional fuel injectors, the differential angle, $\theta_3$ between the seating surface 27 and the region 20*a* of the valve member 29 is typically 0.5°. In the present invention, due to the shaping of the region 20*a* the differential angle, $\theta_3$ is greater (typically 1.5°) whilst a minimum clearance is still maintained along the remainder of the valve member surface. This helps to prevent the build up of fuel lacquer deposits on the seating surface 27 and provides a hydraulic "cushioning" effect upon closure of the valve member.

It will be appreciated that $\theta_1$ and $\theta_2$ may take different values to those described previously, and that the angular difference between $\theta_1$ and $\theta_2$ need not be 1°, whilst still achieving the advantages of the present invention. In addition, it will be appreciated that the length of the region 20*a,* and the diameter of the seating surface 24*a* may have different dimensions to those mentioned previously.

The injection nozzle of the present invention may be incorporated in a unit/pump injector or in a fuel injector arranged to be supplied with fuel from a common rail fuel system. It will be appreciated that movement of the valve member 20 within the blind bore to open and close the outlet openings of the injector may be controlled in any appropriate manner, for example by means of a piezoelectric or electromagnetic actuator arrangement and that the fuel injector may be of the single or multi stage lift type, the nozzle body of the injector being provided with an appropriate number of outlet openings for fuel accordingly.

It will also be appreciated that the injection nozzle of the present invention may be used in controlling the delivery of any fluid, and is not limited to use in injecting fuel.

In order to make the injection nozzle, the valve member is machined to form the first region 20*a* of substantially frusto-conical form which is shaped to subtend a first cone angle, $\theta_2$ and to define the seating surface 24*a* which is engageable with the valve seating surface 27 to control fuel delivery from the injection nozzle. The valve member is also machined to form the second region 20*b* of frusto-conical form which, when the valve member is seated against the valve seating surface 27, in use, adopts a position in which it is located downstream of the valve seating surface 27. The second region 20*b* is machined such that it subtends a second cone angle, $\theta_2$ which is less than the first cone angle, $\theta_1$, subtended by the first region 20*a*.

Obviously, many modifications and variations of the present invention are possible in light of the above teachings. The invention may be practiced otherwise than as specifically described within the scope of the appended claims.

What is claimed is:

1. An injection nozzle for use in delivering fuel to a combustion space, the injection nozzle comprising:

a nozzle body provided with a blind bore; and, a valve member which is slidable within the blind bore, the valve member including a first region of substantially frusto-conical form defining a seating surface which is engageable with a valve seating surface defined by the blind bore to control fuel delivery from the injection nozzle, and a second region arranged such that, when the valve member is seated against the valve seating surface, in use, the second region is located downstream of the valve seating surface, wherein the first region subtends a first cone angle which is greater than a second cone angle subtended by the second region wherein the angular difference between the first cone angle subtended by the first region and the second cone angle subtended by the second region is substantially 1°.

2. An injection nozzle as claimed in claim 1, wherein the second region of the valve member is an end region of the valve member.

3. A valve member as claimed in claim 1, wherein the end region of the valve member is of substantially conical or frusto-conical form.

4. The injection nozzle as claimed claim 1, wherein the differential angle between the valve seating surface and the seating surface defined by the first region is at least 1.5°.

5. An injection nozzle for use in delivering fuel to a combustion space, the injection nozzle comprising:

a nozzle body provided with a blind bore; and, a valve member which is slidable within the blind bore, the valve member including a first region of substantially frusto-conical form defining a seating surface which is engageable with a valve seating surface defined by the blind bore to control fuel delivery from the injection nozzle, and a second region arranged such that, when the valve member is seated against the valve seating surface, in use, the second region is located downstream of the valve seating surface, wherein the first region subtends a first cone angle which is greater than a second cone angle subtended by the second region, wherein the first cone angle subtended by the first region is substantially 61° and the second cone angle subtended by the second region is substantially 60°.

6. A method of manufacturing an injection nozzle for use in delivering fuel to a combustion space, the injection nozzle comprising a nozzle body and a valve member, the method comprising:

providing the nozzle body with a blind bore which is shaped to define a valve seating surface;

machining the valve member to include a first region of substantially frusto-conical form which is shaped to subtend a first cone angle, the first region defining a seating surface which is engageable with the valve seating surface to control fuel delivery from the injection nozzle; and machining the valve member to include a second region, the second region positioned immediately downstream of the first region and forming an end region of the valve member, the region which, when the valve member is seated against the valve seating surface, in use, adopts a position in which it is located downstream of the valve seating surface, and is shaped to subtend a second cone angle, wherein the first and second regions of the valve member are machined such that the first cone angle is greater than the second cone angle.

7. An injection nozzle for use in delivering fuel to a combustion space, the injection nozzle comprising a valve member which is slidable within a blind bore provided in a nozzle body, the valve member including a first region of substantially conical form defining a seating surface which is engageable with a valve seating surface defining by the blind bore to control fuel delivery from the injection nozzle, a second region arranged such that when the valve member is seated against the valve seating surface, in use, the second region is located immediately downstream of the valve seating surface, wherein the second region is positioned immediately downstream of the first region, forms an end region of the valve member and is of substantially conical or frusto-conical form, and wherein the first region subtends a first cone angle which is greater than a second cone angle subtended by the second region, the first and second end regions ensuring a hydraulic cushioning effect is achieved upon closure of the valve member, in use.

8. An injection nozzle as claimed in claim 7, wherein the angular difference between the first cone angle subtended by the first region and the second cone angle subtended by the second region is substantially 1°.

9. An injection nozzle as claimed in claim 7, wherein the first cone angle subtended by the first region is substantially 61° and the second cone angle subtended by the second region is substantially 60°.

10. An injection nozzle as claimed in claim 7, wherein the differential angle between the valve seating surface and the seating surface defined by the first region is at least 1.5°.

* * * * *